US011239591B2

(12) United States Patent
Morita et al.

(10) Patent No.: US 11,239,591 B2
(45) Date of Patent: Feb. 1, 2022

(54) CONNECTOR AND ELECTRONIC DEVICE

(71) Applicant: KYOCERA Corporation, Kyoto (JP)

(72) Inventors: Shunsuke Morita, Yokohama (JP); Masayoshi Kakino, Yokohama (JP); Masashi Kakeno, Yokohama (JP)

(73) Assignee: KYOCERA Corporation, Kyoto (JP)

( * ) Notice: Subject to any disclaimer, the term of this patent is extended or adjusted under 35 U.S.C. 154(b) by 0 days.

(21) Appl. No.: 16/753,521

(22) PCT Filed: Oct. 1, 2018

(86) PCT No.: PCT/JP2018/036739
§ 371 (c)(1),
(2) Date: Apr. 3, 2020

(87) PCT Pub. No.: WO2019/069869
PCT Pub. Date: Apr. 11, 2019

(65) Prior Publication Data

US 2020/0313327 A1 Oct. 1, 2020

(30) Foreign Application Priority Data

Oct. 6, 2017 (JP) ..... JP2017-196003

(51) Int. Cl.
*H01R 12/91* (2011.01)
*H01R 12/71* (2011.01)
(Continued)

(52) U.S. Cl.
CPC ..... *H01R 12/91* (2013.01); *H01R 12/716* (2013.01); *H01R 12/737* (2013.01);
(Continued)

(58) Field of Classification Search
CPC ..... H01R 13/6474; H01R 13/2492; H01R 13/6315; H01R 12/91; H01R 13/502; H01R 12/716; H01R 12/737; H01R 24/60
(Continued)

(56) References Cited

U.S. PATENT DOCUMENTS 9,022,811 B2 5/2015 Takaki
9,160,122 B2 10/2015 Sato
(Continued)

FOREIGN PATENT DOCUMENTS

CN 104347991 A 2/2015
CN 104347993 A 2/2015
(Continued)

*Primary Examiner* — Marcus E Harcum
(74) *Attorney, Agent, or Firm* — Studebaker & Brackett PC

(57) ABSTRACT

A connector (10) according to the present disclosure includes a first insulator (20), a second insulator (30) that is to be fitted to a connection object (70) and movable relative to the first insulator (20), and a contact (60) attached to the first insulator (20) and the second insulator (30). The contact (60) includes a first elastic portion (64A) that extends from a first base (61) supported by the first insulator (20) and is elastically deformable; an adjustment portion (64B) that is formed to be continuous with the first elastic portion (64A) and has a higher electrical conductivity than the first elastic portion (64A); a second elastic portion (64C) that extends to the second insulator (30) from the adjustment portion (64B) and is elastically deformable; and a contact portion (69) that electrically connects to the connection object (70) when the second insulator (30) and the connection object (70) are fitted together.

9 Claims, 13 Drawing Sheets

(51) Int. Cl.

| | |
|---|---|
| ***H01R 12/73*** | (2011.01) |
| ***H01R 13/24*** | (2006.01) |
| ***H01R 13/631*** | (2006.01) |
| ***H01R 24/60*** | (2011.01) |
| *H01R 13/646* | (2011.01) |
| *H01R 107/00* | (2006.01) |

(52) U.S. Cl.
CPC ..... *H01R 13/2492* (2013.01); *H01R 13/6315* (2013.01); *H01R 24/60* (2013.01); *H01R 13/646* (2013.01); *H01R 2107/00* (2013.01)

(58) Field of Classification Search
USPC ..... 439/246–248
See application file for complete search history.

(56) References Cited

U.S. PATENT DOCUMENTS

| | | | | |
|---|---|---|---|---|
| 9,331,414 | B2 | 5/2016 | Doi et al. | |
| 9,484,656 | B2 * | 11/2016 | Doi | H01R 13/41 |
| 9,979,107 | B1 * | 5/2018 | Ootani | H01R 13/2492 |
| 10,608,361 | B2 * | 3/2020 | Teruki | H01R 13/424 |
| 10,673,158 | B2 * | 6/2020 | Aoki | H01R 13/642 |
| 2009/0239421 | A1 * | 9/2009 | Fukazawa | H01R 12/91 439/660 |
| 2009/0239422 | A1 * | 9/2009 | Fukazawa | H01R 12/716 439/660 |
| 2010/0075536 | A1 * | 3/2010 | Kubo | H01R 13/6477 439/620.21 |
| 2015/0044901 | A1 | 2/2015 | Doi et al. | |
| 2015/0044917 | A1 | 2/2015 | Takaki | |
| 2015/0132998 | A1 | 5/2015 | Sato | |
| 2015/0132999 | A1 * | 5/2015 | Sato | H01R 24/60 439/676 |
| 2016/0204536 | A1 | 7/2016 | Doi et al. | |
| 2016/0294111 | A1 * | 10/2016 | Kobayashi | H01R 12/716 |
| 2016/0308311 | A1 * | 10/2016 | Hori | H01R 13/7032 |
| 2017/0033480 | A1 * | 2/2017 | Sato | H01R 13/04 |
| 2017/0338592 | A1 * | 11/2017 | Doi | H01R 12/7035 |
| 2018/0198234 | A1 * | 7/2018 | Takane | H01R 12/716 |
| 2018/0337482 | A1 * | 11/2018 | Teruki | H01R 13/506 |
| 2019/0020134 | A1 * | 1/2019 | Suzuki | H01R 12/52 |
| 2019/0052005 | A1 * | 2/2019 | Hasegawa | H01R 13/405 |
| 2019/0109396 | A1 * | 4/2019 | Shimba | H01R 12/716 |
| 2019/0148884 | A1 * | 5/2019 | Sugiki | H01R 13/05 439/247 |

FOREIGN PATENT DOCUMENTS

| | | | |
|---|---|---|---|
| EP | 2 835 874 | A1 | 2/2015 |
| JP | 2012-129109 | A | 7/2012 |
| JP | 5481594 | B1 | 4/2014 |
| JP | 5568677 | B1 | 8/2014 |
| JP | 2015-035352 | A | 2/2015 |
| JP | 2015-035407 | A | 2/2015 |

* cited by examiner

CONNECTOR AND ELECTRONIC DEVICE

CROSS REFERENCE TO RELATED APPLICATION

This application claims priority to and the benefit of Japanese Patent Application No. 2017-196003 filed on Oct. 6, 2017, the entire contents of which are incorporated herein by reference.

TECHNICAL FIELD

The present disclosure relates to a connector and an electronic device.

BACKGROUND

As a technique for improving reliable connectivity to a connection object, for example, a connector having a floating structure in which a positional deviation between circuit boards is accommodated by movement of a portion of the connector during and after fitting is known.

PTL 1 set forth below discloses an electrical connector that has a floating structure and contributes to miniaturization while suppressing conduction failure caused by flux rising.

CITATION LIST

Patent Literature

PTL 1: Japanese Patent No. 5568677

SUMMARY

A connector according to an embodiment of the present disclosure includes:

- a first insulator;
- a second insulator that is to be fitted to a connection object and movable relative to the first insulator; and
- a contact attached to the first insulator and the second insulator, wherein the contact includes:

- a first elastic portion that extends from a first base supported by the first insulator and is elastically deformable;
- an adjustment portion that is formed to be continuous with the first elastic portion and has a higher electrical conductivity than the first elastic portion;
- a second elastic portion that extends to the second insulator from the adjustment portion and is elastically deformable; and
- a contact portion that electrically connects to the connection object when the second insulator and the connection object are fitted together.

BRIEF DESCRIPTION OF THE DRAWINGS

In the accompanying drawings:

FIG. 4 is an exploded top perspective view of the connector illustrated in

FIG. 3;

DETAILED DESCRIPTION

Figure 1:
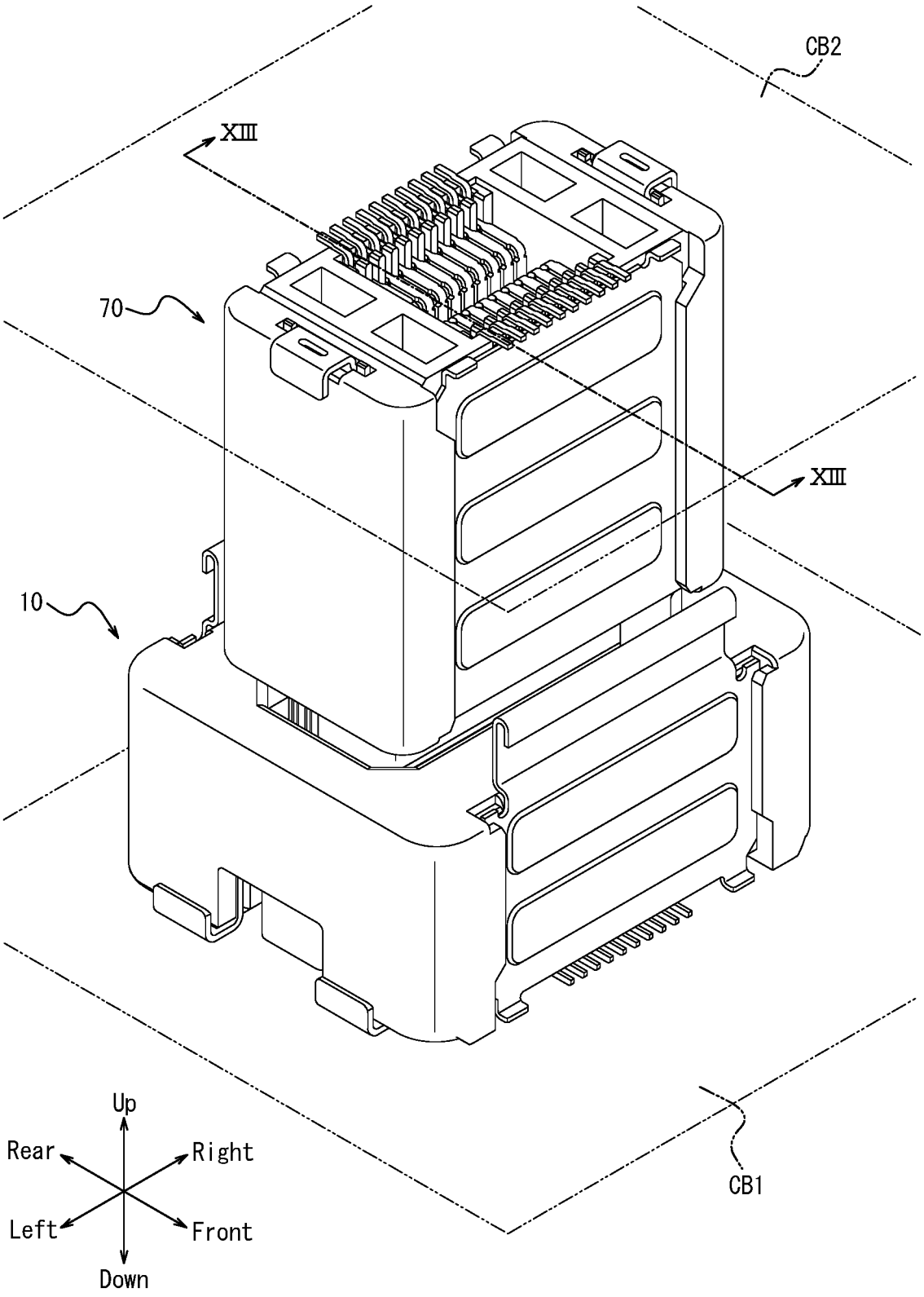
FIG. 1 is an external top perspective view illustrating a state in which a connector according to an embodiment and a contact object are coupled together.

In recent years, information amounts and communication speeds for electronic devices are increasing. Connectors utilizing floating structures need to be designed to support such large capacity and high-speed transmission. However, the electric connector described in PTL 1 does not sufficiently consider designs that support large capacity and high-speed transmission.

A connector according to an embodiment of the present disclosure can realize both a good floating structure and good transmission characteristics for signal transmission.

Hereinafter, an embodiment of the present disclosure will be described with reference to the accompanying drawings. Terms such as "front-rear direction", "left-right direction", and "up-down direction" as used herein correspond to the directions indicated by arrows in the drawings. The directions indicated by the arrows in FIG. 1 to FIG. 9 and FIG. 13 correspond with each other. The directions indicated by the arrows in FIG. 11 and FIG. 12 correspond with each other. Further, the directions indicated by the arrows in FIG. 14 and FIG. 15 correspond with each other. In some drawings, circuit boards CB1 and CB2 are omitted for the purpose of simplified illustration.

In the following description, the connector 10 according to the embodiment is described as a receptacle connector. In the following description, the connection object 70 is described as a plug connector. When the connector 10 and the connection object 70 are to be coupled, a contact portion of a contact 60 of the connector 10 elastically deforms, and a contact 110 of the connection object 70 does not elastically deform. Further variants of the connector 10 and the connection object 70 are not limited to this configuration. The connector 10 and the connection object 70 may function as the plug connector and the receptacle connector, respectively.

In the following description, it is assumed that the connector 10 and the connection object 70 are coupled to a circuit board CB1 and a circuit board CB2, respectively, in a direction perpendicular thereto, by way of example. In particular, the connector 10 and the connection object 70 are coupled together along, for example, the up-down direction. The term "fitting direction" used in the following description refers to the up-down direction, by way of example. The manner in which the connector 10 and the connection object 70 are connected is not limited thereto. The connector 10 and the connection object 70 may be connected parallel to the circuit board CB1 and the circuit board CB2, respectively. Alternatively, one of the connector 10 and the connection object 70 may be connected perpendicular to the corresponding circuit board while the other is connected in parallel to the corresponding circuit board. The circuit boards CB1 and CB2 may be rigid boards or any other circuit boards. For example, the circuit board CB1 or the circuit board CB2 may be a flexible printed circuit board (FPC).

Figure 2:
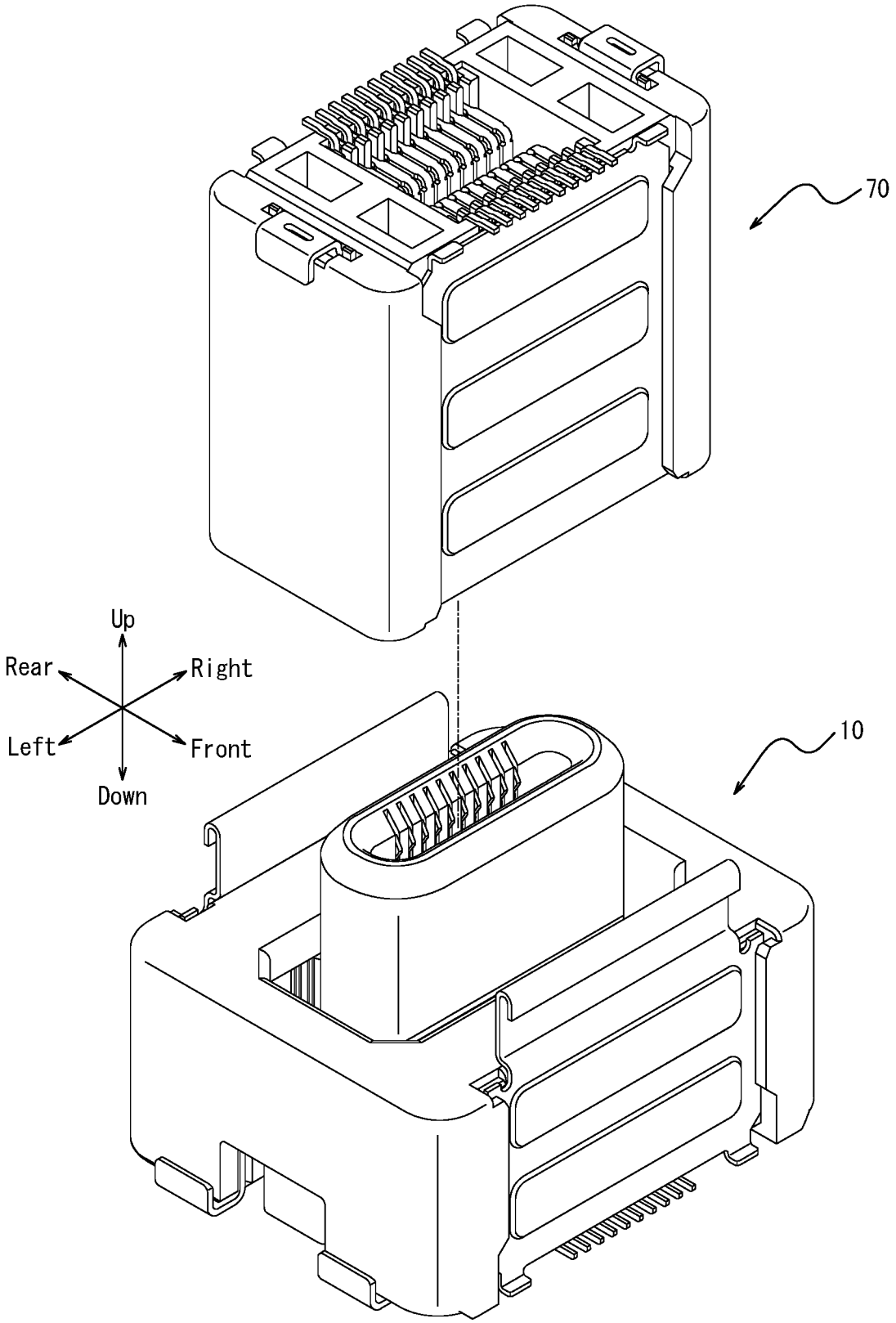
FIG. 2 is an external top perspective view illustrating a state in which the connector according to the embodiment and the contact object are separated from each other.

FIG. 1 is an external top perspective view illustrating a state in which a connector 10 according to an embodiment and a connection object 70 are coupled together. FIG. 2 is an external top perspective view illustrating a state in which the connector 10 according to the present embodiment and the connection object 70 are separated from each other.

The connector 10 according to the present embodiment has a floating structure. The connector 10 allows relative movement of the connection object 70 connected thereto with respect to the circuit board CB1. That is, the connection object 70 connected to the connector 10 may move within a predetermined range with respect to the circuit board CB1.

Figure 3:
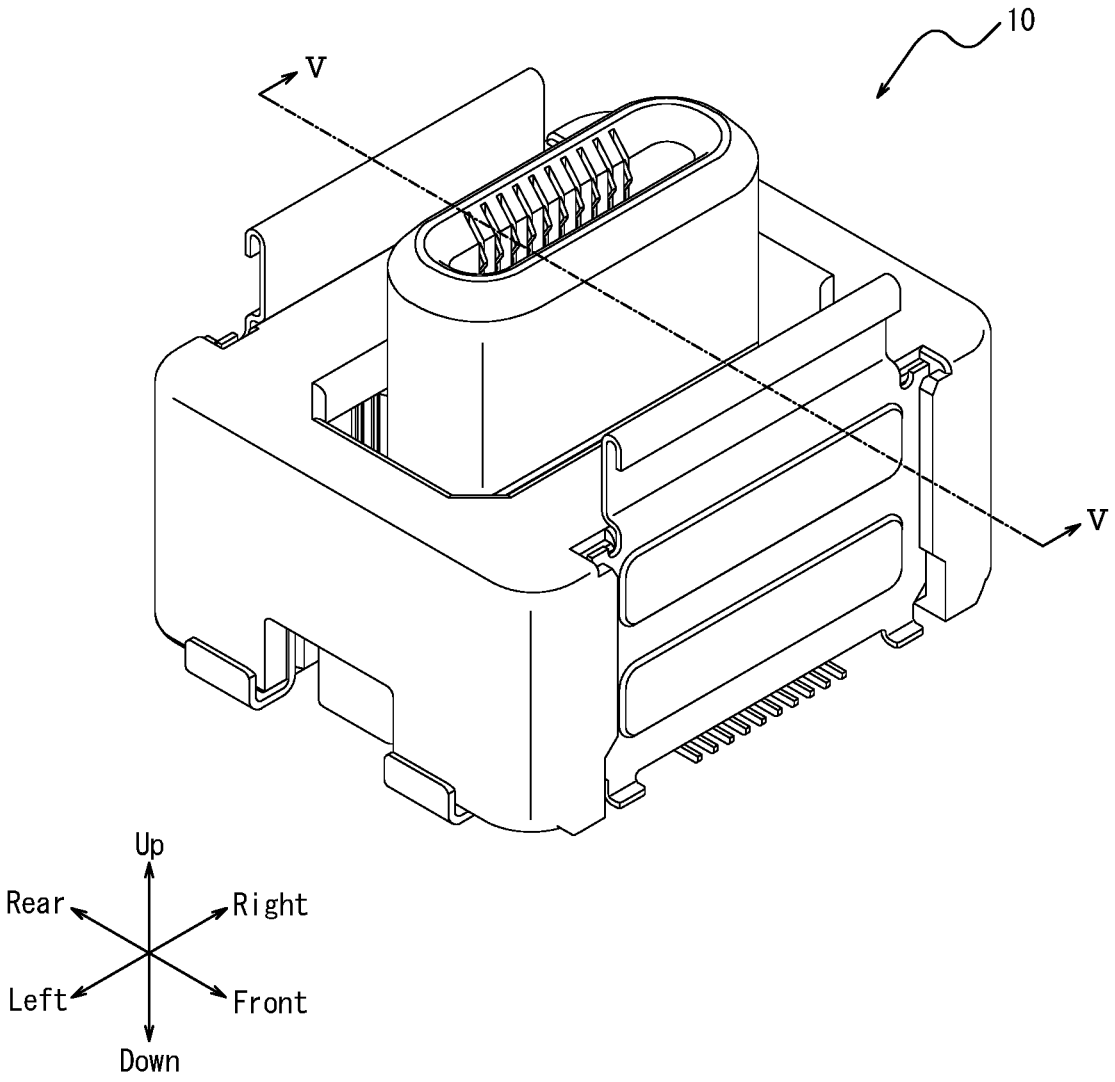
FIG. 3 is an external top perspective view illustrating the connector according to the embodiment.
Figure 4:
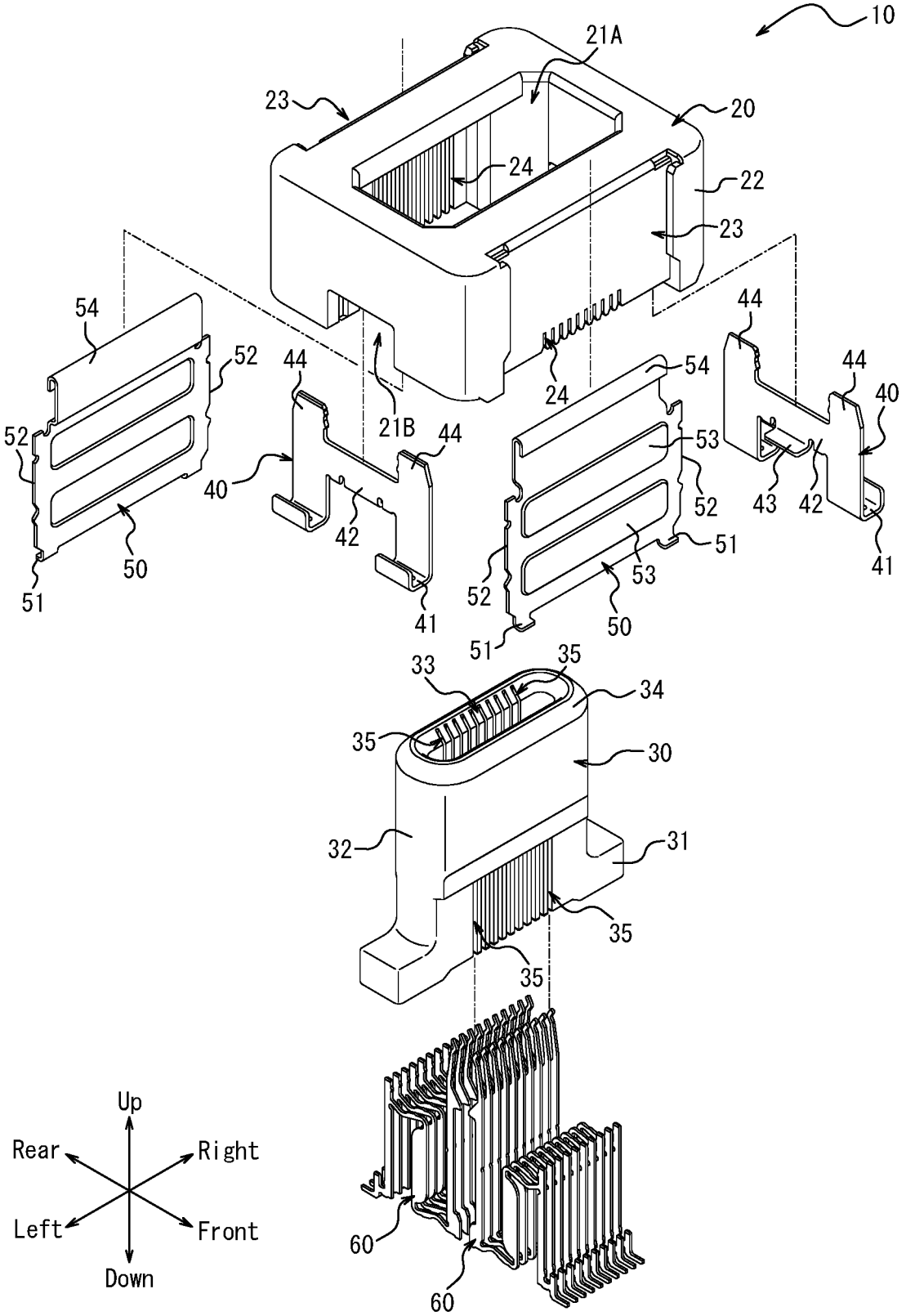
Figure 5:
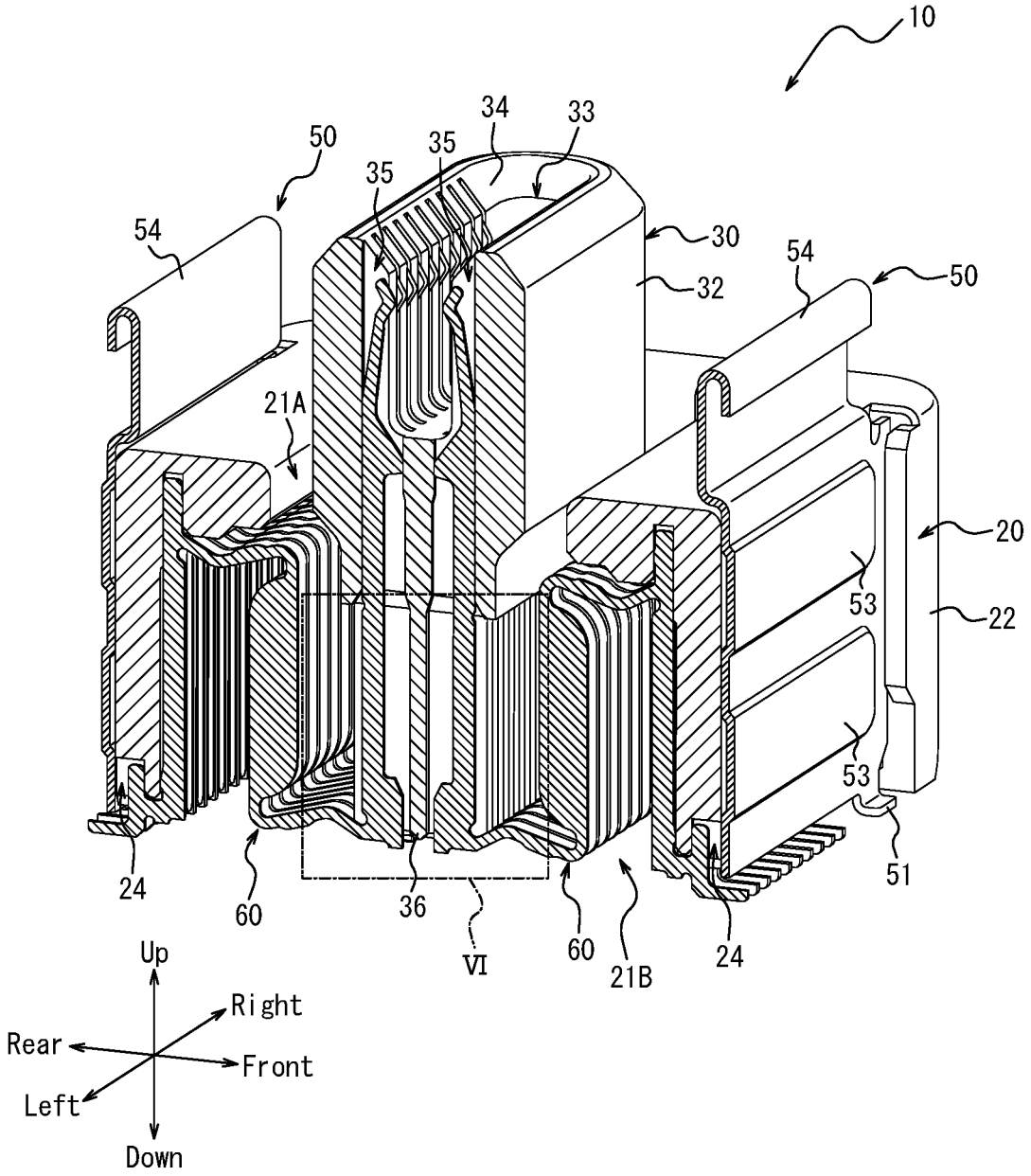
FIG. 5 is a perspective cross-sectional view taken from arrow V-V illustrated in FIG. 3.
Figure 6:
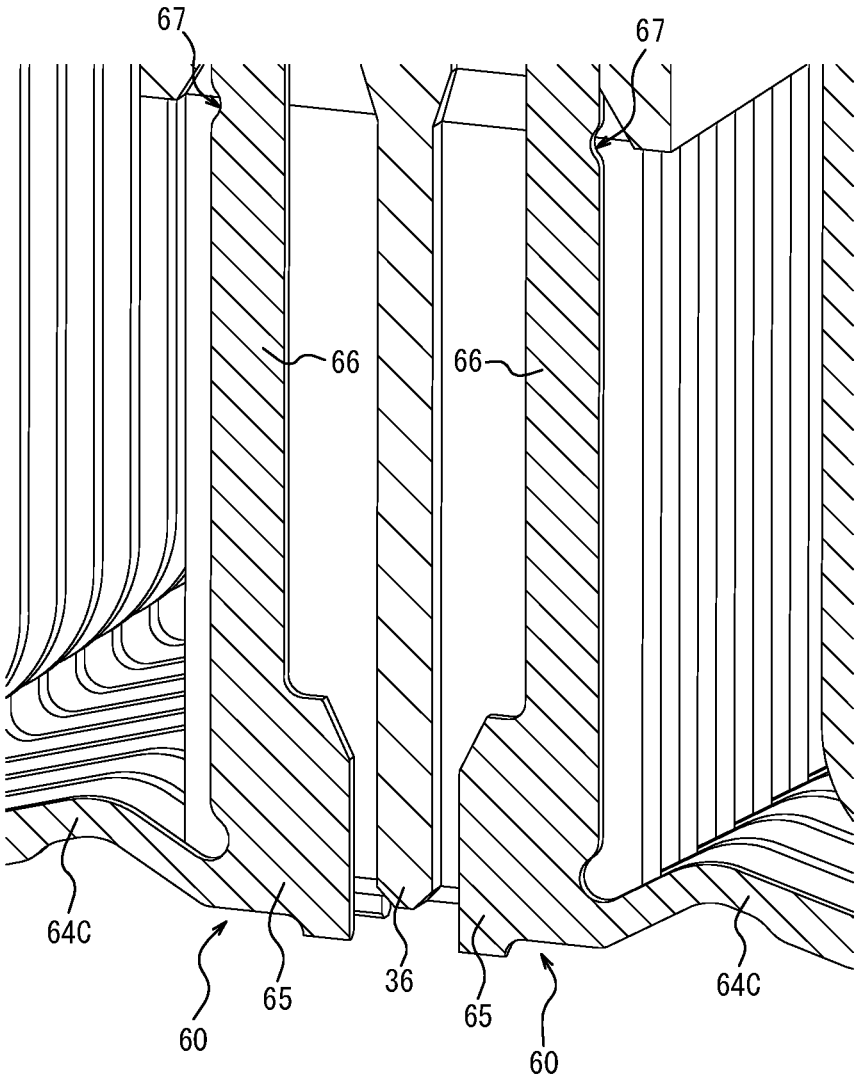
FIG. 6 is an enlarged view of a portion VI illustrated in FIG. 5.
Figure 6:
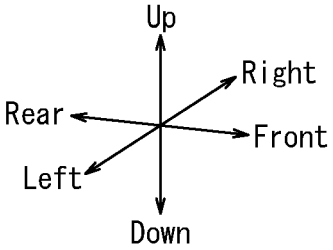
Figure 7:
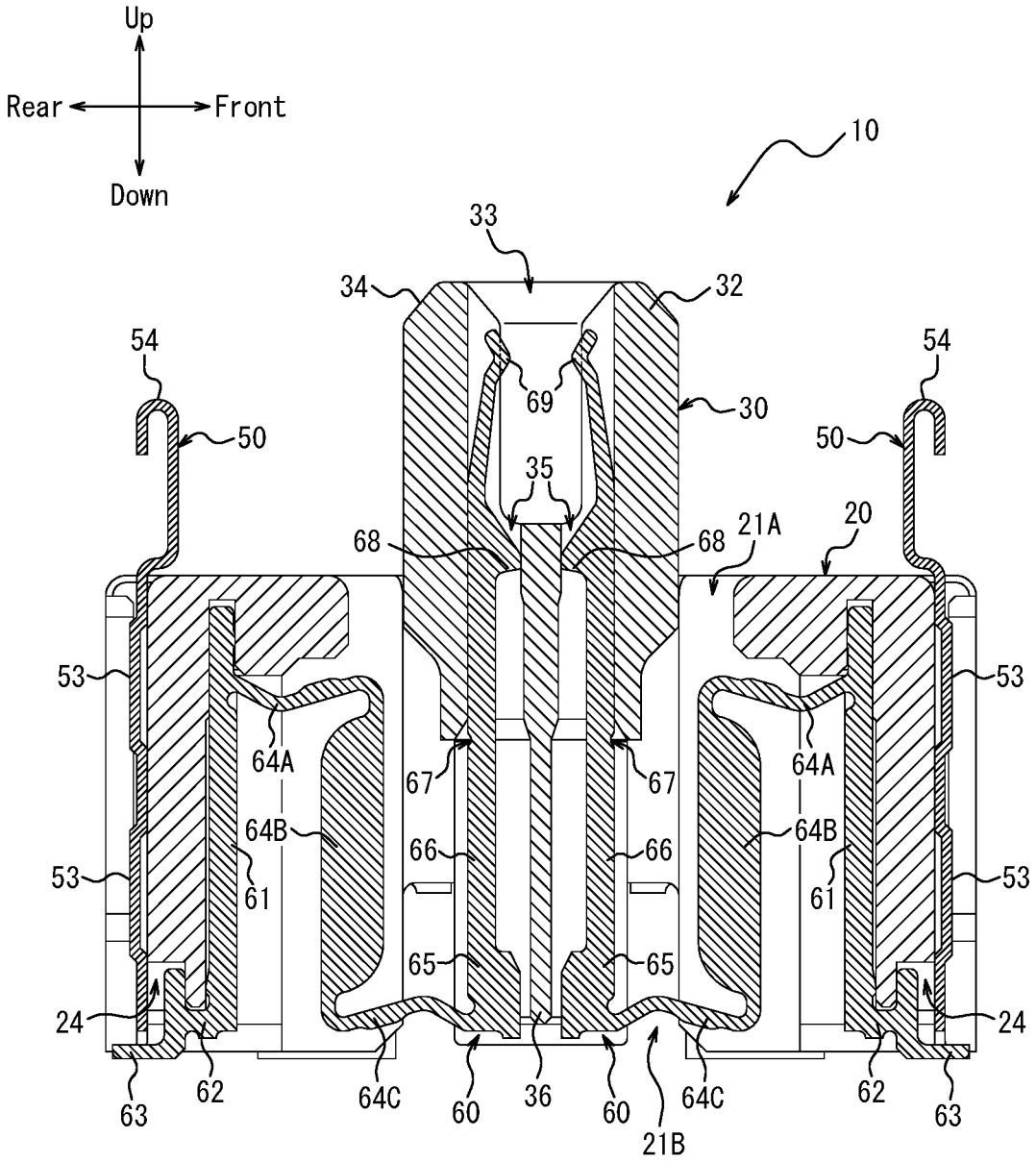
FIG. 7 is a cross-sectional view taken from arrow V-V illustrated in FIG. 3.
Figure 8:
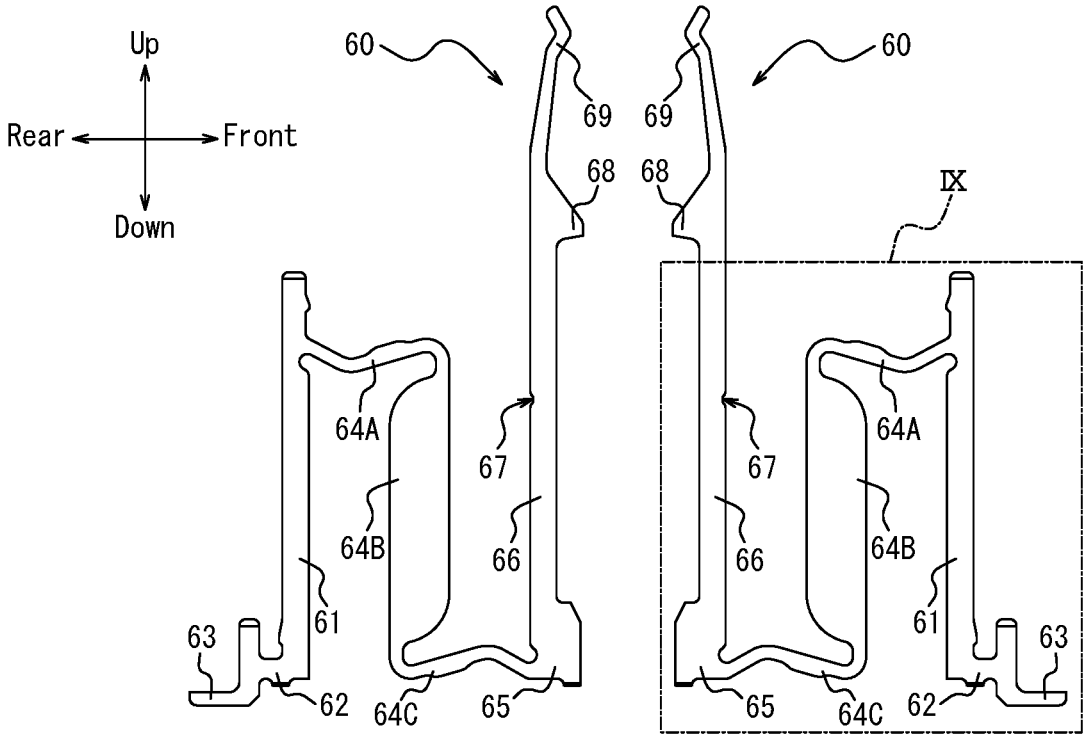
FIG. 8 is an elevation view of a pair of contacts.
Figure 9:
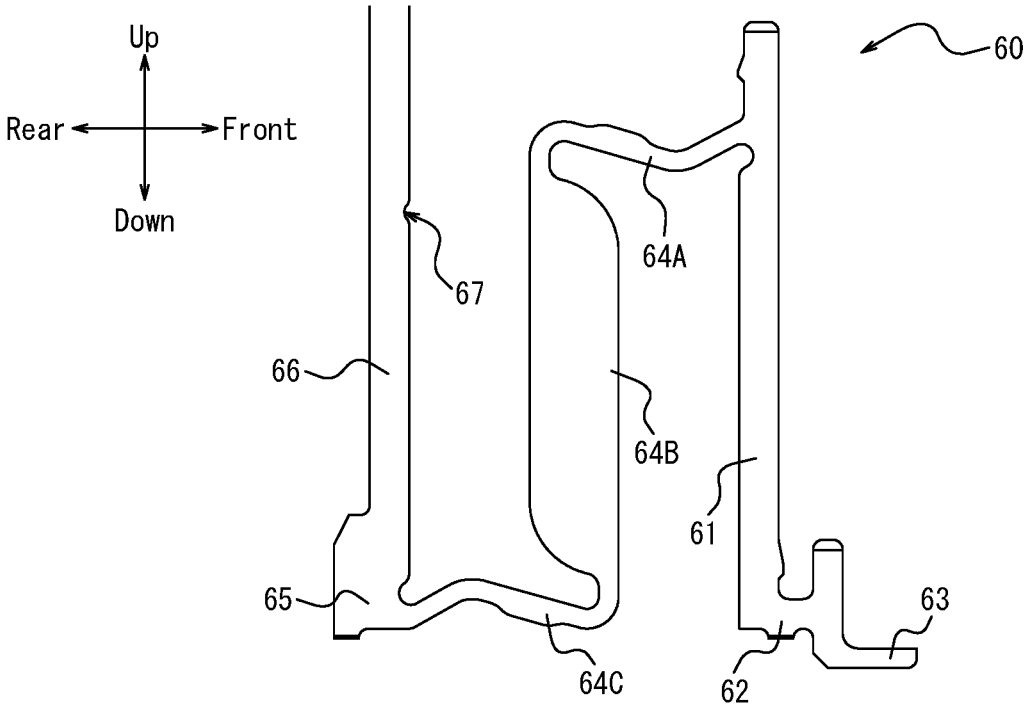
FIG. 9 is an enlarged view of a portion IX illustrated in FIG. 8.

FIG. 3 is an external top perspective view of the connector 10 according to the present embodiment. FIG. 4 is an exploded top perspective view of the connector 10 illustrated in FIG. 3. FIG. 5 is a perspective cross-sectional view taken from arrow V-V illustrated in FIG. 3. FIG. 6 is an enlarged view of a portion VI illustrated in FIG. 5. FIG. 7 is a cross-sectional view taken from arrow V-V illustrated in FIG. 3. FIG. 8 is an elevation view of a pair of contacts 60. FIG. 9 is an enlarged view of a portion IX illustrated in FIG. 8.

As illustrated in FIG. 4, the connector 10 includes, as main constituent elements, a first insulator 20, a second insulator 30, fitting brackets 40, fitting sheets 50, and contacts 60. The connector 10 is assembled in the following manner by way of example. The fitting brackets 40 are press-fitted into the first insulator 20 from below. The second insulator 30 is arranged in the first insulator 20 having the fitting brackets 40 press-fitted thereinto. The contacts 60 are press-fitted into the first insulator 20 and the second insulator 30 from below. The fitting sheets 50 are press-fitted on outer surfaces of the first insulator 20.

A configuration of the connector 10 in a state in which the contacts 60 are not elastically deformed will be described in detail with reference mainly to FIG. 3 to FIG. 9.

As illustrated in FIG. 4 and FIG. 5, the first insulator 20 is a rectangular tubular member obtained by performing injection molding of a synthetic resin material having insulating and heat-resistant properties. The first insulator 20 is hollow and has an opening 21A and an opening 21B on its top surface and bottom surface, respectively. The first insulator 20 includes an outer peripheral wall 22 having four side surfaces surrounding the space therein. The first insulator 20 includes recesses 23 formed on a front surface and a rear surface of the outer peripheral wall 22. The recesses 23 accommodate the fitting sheets 50.

The first insulator 20 includes a plurality of contact attachment grooves 24 formed in the lower edge portion of the outer peripheral wall 22 across the bottom surface and the inner surface. Each of the plurality of contact attachment grooves 24 accommodates a corresponding one of the plurality of contacts 60. The number of the contact attachment grooves 24 matches the number of the contacts 60. The plurality of contact attachment grooves 24 are formed as recesses arranged in the left-right direction. The contact attachment grooves 24 extend in the up-down direction on the inner surface of the first insulator 20.

The second insulator 30 is a member obtained by performing injection molding of a synthetic resin having insulating and heat-resistant properties and extends in the left-right direction. The second insulator 30 is formed in a substantially convex shape in an elevation view from the front side. The second insulator 30 includes a bottom portion 31 that constitutes a lower portion, and a fitting projection 32 that protrudes upward from the bottom portion 31 and is to be fitted to the connection object 70. The bottom portion 31 is longer than the fitting projection 32 in the left-right direction. In other words, the left and right edge portions of the bottom portion 31 respectively protrude outward from the left and right edge portions of the fitting projection 32. The second insulator 30 includes a fitting recess 33 formed as a recess on the top surface of the fitting projection 32. The second insulator 30 includes a guiding portion 34 that is formed surrounding the fitting recess 33 across the top edge portion of the fitting projection 32. The guiding portion 34 is configured as an inclined surface that is inclined obliquely inwardly upward at the top edge portion of the fitting projection 32.

The second insulator 30 includes a plurality of contact attachment grooves 35 that are arranged in the left-right direction. Each of the plurality of contact attachment grooves 35 accommodates a corresponding one of the plurality of contacts 60. The number of the contact attachment grooves 35 matches the number of the contacts 60. The plurality of contact attachment grooves 35 extend in the up-down direction. The lower portions of the contact attachment grooves 35 are formed by the lower portion of the front and rear surfaces of the second insulator 30, each of which is formed as a recess. The middle portions of the contact mounting grooves 35 are formed in the interior of the second insulator 30. The upper portions of the contact attachment grooves 35 are formed by the inner surfaces of the front and rear sides of the fitting recess 33.

The second insulator 30 has a wall 36 that downwardly extends towards the bottom surface of the fitting recess 33 therein. The wall 36 is positioned between the pair of contacts 60 attached to the second insulator 30 in a state of being arranged in the front-rear direction. The wall 36 opposes each of the pair of contacts 60. An upper portion of the wall 36 is formed to have the greatest width. A middle portion of the wall 36 is formed to be narrower than the upper portion. The lower portion of the wall 36 is formed to be narrower than the middle portion. The front and rear surfaces of the wall 36 constitute a portion of the contact attachment grooves 35. The middle portion of the contact attachment grooves 35 formed in the second insulator 30 becomes narrow toward the upper portion from the lower portion in accordance with the change in the width of the middle portion and the upper portion of the wall 36.

The fitting brackets 40 are obtained by shaping a thin plate made of any metallic material into a shape as illustrated in FIG. 4 using a progressive die (stamping). The fitting brackets 40 are arranged at the left and right edge portions of the first insulator 20. Each of the fitting brackets 40 in its entirety is formed in a substantially H-shape in an elevation view from the left-right direction. Each of the fitting brackets 40 includes mounting portions 41 that extend outwardly in a substantially U-shape from the bottom edge portions on the front and rear sides. Each of the fitting brackets 40 includes a connection portion 42 that extends in the front-rear direction at an approximately middle portion of the corresponding fitting bracket 40 in the up-down direction. Each of the fitting brackets 40 includes a retainer portion 43 that inwardly extends in the left-right direction from the bottom edge of the approximately middle portion of the connection portion 42 in the front-rear direction. The retainer portion 43 suppresses removal of the second insulator 30 from the first insulator 20 in the upward direction. Each of the fitting brackets 40 includes fitting portions 44 to be fitted in the first insulator 20.

The fitting sheets 50 are obtained by shaping a thin plate made of any metallic material into a shape as illustrated in FIG. 4 using a progressive die (stamping). The fitting sheets 50 are arranged at the front and rear edge portions of the first insulator 20. Each of the fitting sheets 50 in its entirety is formed in a plate-like shape in an elevation view from the front-rear direction. Each of the fitting sheets 50 includes mounting portions 51 that outwardly extend in a substantially L-shape from the left and right edge portions of the corresponding fitting sheet 50. Each of the fitting sheets 50 includes retainer portions 52 that extend in the up-down direction at the left and right edge portions of the fitting sheet 50 and latch to the first insulator 20. Each of the fitting sheets 50 includes ridges 53 formed as steps that outwardly protrude on the outer surface and extend in the left-right direction. Each of the fitting sheets 50 includes two ridges 53 that are arranged in parallel in the up-down direction. Each of the fitting sheets 50 includes a bent portion 54 that extends upward. The bent portion 54 is formed in a substantially J-shape and bent outward from the inside.

The contacts 60 are obtained by shaping a thin plate made of, for example, a copper alloy having spring elasticity such as phosphor bronze, beryllium copper, or titanium copper, or a Corson type copper alloy into the shape as illustrated in FIG. 4 to FIG. 9 by using a progressive die (stamping). The contacts 60 are formed by punching alone. Processing methods for the contacts 60 is not limited thereto and may include a step of bending a product obtained by punching in the thickness direction. The contacts 60 are made of a metallic material having a small elastic coefficient, so as to be largely deformed by elastic deformation. The surface of the contacts 60 is plated with gold or tin after application of a nickel plate undercoat.

As illustrated in FIG. 4, the plurality of contacts 60 are arranged in the left-right direction. As illustrated in FIG. 7, the contacts 60 are fitted in the first insulator 20 and the second insulator 30. As illustrated in FIG. 7 and FIG. 8, a pair of contacts 60 arranged in the same positions on the left and right sides is symmetrically formed and arranged along the front-rear direction. The pair of contacts 60 is formed and arranged so as to be substantially linearly symmetric with respect to a vertical axis passing through the center between the pair of contacts 60.

Each of the contacts 60 includes a first base 61 that extends along the up-down direction and is supported by the first insulator 20. The top edge portion of the first base 61 latches to the first insulator 20. Each of the contacts 60 includes a fixing portion 62 that is formed continuously with the bottom portion of the first base 61 and latches to the first insulator 20. The first base 61 and the fixing portion 62 are accommodated in the contact attachment groove 24 of the first insulator 20. Each of the contacts 60 includes a mounting portion 63 that extends outwardly in a substantially L shape from the outer side of the bottom portion of the fixing portion 62.

As illustrated in FIG. 9, each of the contacts 60 includes a first elastic portion 64A that can elastically deform and extends inward along the front-rear direction from the first base 61. The first elastic portion 64A extends obliquely downward and inward from the first base 61, bends obliquely upwards, and then linearly extends. The first elastic portion 64A once again bends downward at its inner edge portion and is connected to the top edge portion of the adjustment portion 64B. The first elastic portion 64A is formed to be narrower than the first base 61. Thus, the first elastic portion 64A can adjust the portion to elastically deform.

Each of the contacts 60 includes an adjustment portion 64B that is formed continuously with the first elastic portion 63A. The adjustment portion 64B is formed to be wider than the first elastic portion 64A, that is, to have a larger cross-section, whereby the adjustment portion 64B has a higher electrical conductivity than the first elastic portion 64A. In a state in which the contact 60 is not elastically deformed, the adjustment portion 64B extends in a fitting direction for the connection object 70, i.e., the up-down direction.

Each of the contacts 60 includes a second elastic portion 64C that can elastically deform and extends to the second insulator 30 from the bottom of the adjustment portion 64B. The second elastic portion 64C bends obliquely upward from the bottom of the adjustment portion 64B and linearly extends in that state. The second elastic portion 64C once again bends obliquely downward and is connected to an outer edge portion of the second base 65, which will be described later. The second elastic portion 64C is formed to be narrower than the adjustment portion 64B, in a manner similar to the first elastic portion 64A. Thus, the second elastic portion 64C can adjust a portion to elastically deform.

The first elastic portion 64A, the adjustment portion 64B, and the second elastic portion 64C are integrally formed in a substantially crank shape. The first elastic portion 64A and the second elastic portion 64C are symmetrically formed with each other with respect to the adjustment portion 64B. The first elastic portion 64A and the second elastic portion 64C are formed to be substantially point symmetrical to each other with respect to the center of the adjustment portion 64B.

The first elastic portion 64A and the second elastic portion 64C extend from the respective edge portions of the adjustment portion 64B in the fitting direction. In particular, the first elastic portion 64A extends from the inner portion of the upper edge portion of the adjustment portion 64B. On the other hand, the second elastic portion 64C extends from the outer portion of the lower edge portion of the adjusting portion 64B. Thus, the connection point between the first elastic portion 64A and the adjusting portion 64B and the connection point between the second elastic portion 64C and the adjusting portion 64B are formed at positions symmetrical to each other with respect to the center of the adjustment portion 64B.

Each of the contacts 60 includes a second base 65 continuous with the second elastic portion 64C, as illustrated in FIG. 7 and FIG. 8. The second base 65 is formed to be wider than the second elastic portion 64C and thus has higher rigidity. Each of the contacts 60 includes a third elastic portion 66 that can elastically deform and extends upward from the second base 65 and is arranged along the inner wall of the second insulator 30. In a state in which the third elastic portion 66 does not elastically deform, the third elastic portion 66 extends in a fitting direction to be fitted in the connection object 70, that is, the up-down direction. The third elastic portion 66 opposes the wall 36 of the second insulator 30 formed therein. Each of the contacts 60 includes a notch 67 that is formed on the surface of the third elastic portion 66 in a manner constituting a bending point at the time of elastic deformation of the third elastic portion 66. The notch is formed as a cut-out on the surface at approximately the center of the outer surface of the third elastic portion 66 in the front-rear direction. Each of the contacts 60 includes a latch 68 that is formed on top of the third elastic portion 66 and latches to the second insulator 30. The latch 68 is formed to be wider than the third elastic portion 66. The contact 60 includes an elastic contact portion 69 that is formed continuously from the top edge of the latch 68 and comes into contact with the contact 110 of the connection object 70 at the time of fitting.

As illustrated in FIG. 7, the second bases 65, the third elastic portions 66, the notches 67, and the latches 68 are accommodated in the contact attachment grooves 35 of the second insulator 30. The second bases 65, the third elastic portions 66, and the latches 68, in substantially their entirety, oppose the wall 36 of the second insulator 30 formed on the inner side. As illustrated in FIG. 6, the second bases 65 connecting the second elastic portions 64C and the third elastic portions 66 together are arranged at positions facing the lower end portion of the wall 36.

As illustrated in FIG. 7, the second bases 65 and the lower half portions of the third elastic portions 66 are accommodated in the lower portions of the contact attachment grooves 35 formed as recesses on the front and rear surfaces of the second insulator 30. The upper half portions of the third elastic portions 66 and the latches 68 are accommodated in the central portions of the contact attachment grooves 35 formed by the inside of the second insulator 30. The notches 67 are formed on the surfaces of the third elastic portions 56 in the vicinity of boundaries between the lower portions and the central portions of the contact attachment grooves 35.

The elastic contact portions 69 are substantially accommodated in the upper portions of the contact attachment grooves 35 configured as recesses formed on the inner surfaces of the fitting recess 33 of the second insulator 30. The distal ends of the elastic contact portions 69 are exposed to the fitting recess 33 from the contact attachment grooves 35.

Figure 10:
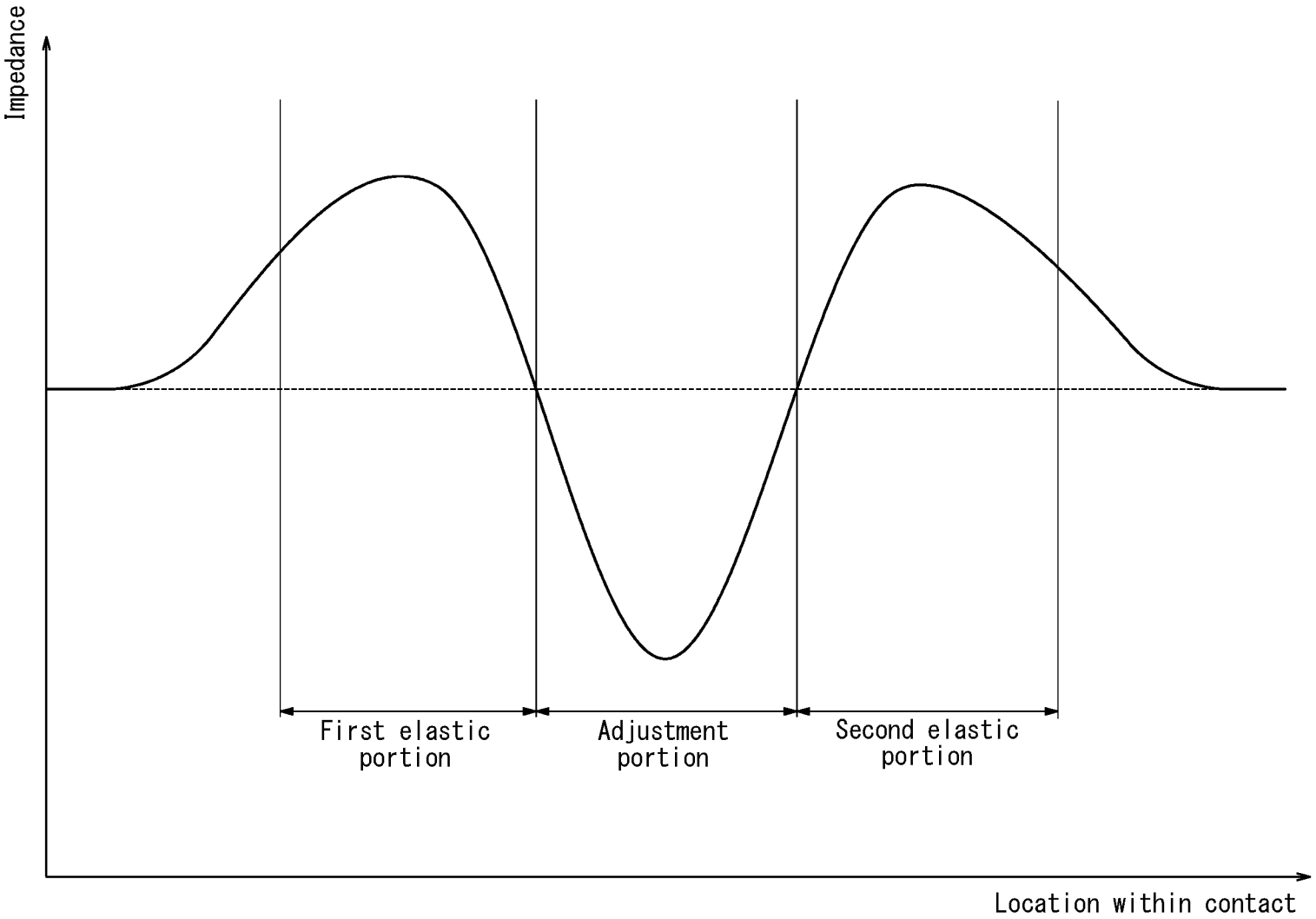
FIG. 10 is a graph schematically illustrating an impedance change in a first elastic portion, an adjustment portion, and a second elastic portion of the contact.

FIG. 10 is a schematic diagram illustrating an impedance change in the first elastic portion 64A, the adjustment portion 64B, and the second elastic portion 64C of each of the contacts 60. Functions of the adjustment portions 64B will be described with reference to FIG. 10. In FIG. 10, the vertical axis indicates the magnitude of the impedance. The horizontal axis indicates a position on a contact 60. The solid line represents a measured value of the impedance. The broken line represents an ideal value of the impedance.

The overall impedance of the first elastic portion 64A, the adjustment portion 64B, and the second elastic portion 64C is adjusted by the adjustment portion 64B. In each of the contacts 60, the first elastic portion 64A is formed to be narrow (has a narrow cross-sectional area) in order to obtain a large elastic deformation amount. Thus, the impedance adjusted to the ideal value increases in the first elastic portion 54A. Because the adjusting portion 64B formed continuously with the first elastic portion 64A is formed to be wide (has a large cross-sectional area), it is intended to cause the impedance, which increased in the first elastic portion 64A, to fall below the ideal value in the adjusting portion 64B. Because the second elastic portion 64C formed to be continuous with the adjustment portion 64B is formed to be narrow (has a narrow cross-sectional area) in a manner similar to the first elastic portion 64A, the impedance, which fell below the ideal value, rises above the ideal value again in the second elastic portion 64C. In this manner, the adjustment portion 64B plays a role of canceling the impedance increase in the first elastic portion 64A and the second elastic portion 64C such that the impedance overall approaches the ideal value.

In the connector 10 structured as described above, the mounting portions 63 of the contacts 60 are soldered to the circuit pattern formed on the mounting surface of the circuit board CB1. The mounting portions 41 of the fitting brackets 40 and the mounting portions 51 of the fitting sheets 50 are soldered to the ground pattern or the like formed on the mounting surface. In this way, the connector 10 is mounted on the circuit board CB1. On the mounting surface of the circuit board CB1, electronic components other than the connector 10 such as, for example, a CPU, a controller, a memory, and the like are mounted.

A configuration of the connection object 70 will be described with reference mainly to FIG. 11 and FIG. 12.

Figure 11:
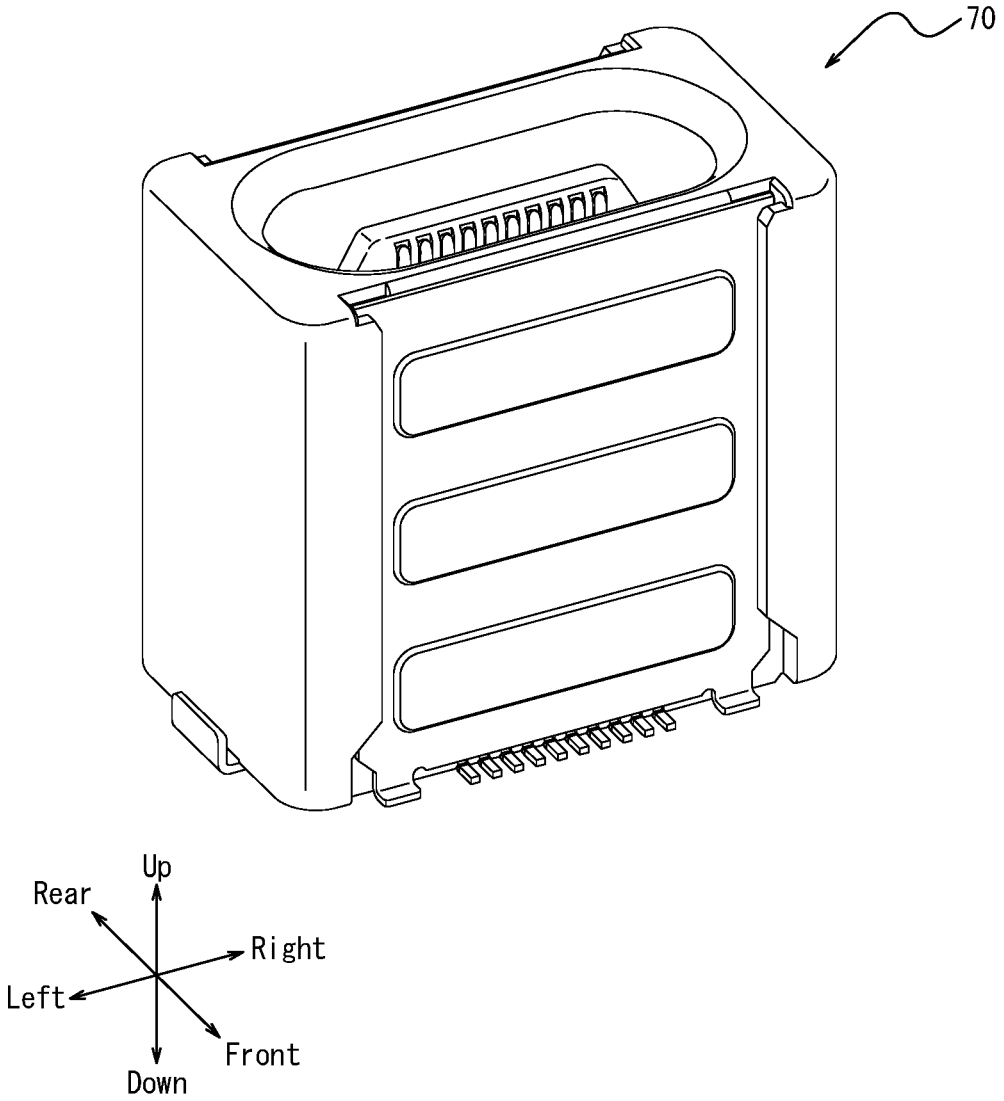
FIG. 11 is an external top perspective view illustrating a connection object to be connected to the connector illustrated in FIG. 3.

FIG. 11 is an external top perspective view illustrating the connection object 70 to be connected to the connector 10 in FIG. 3. FIG. 12 is an exploded top perspective view of the connection object 70 of FIG. 11.

Figure 12:
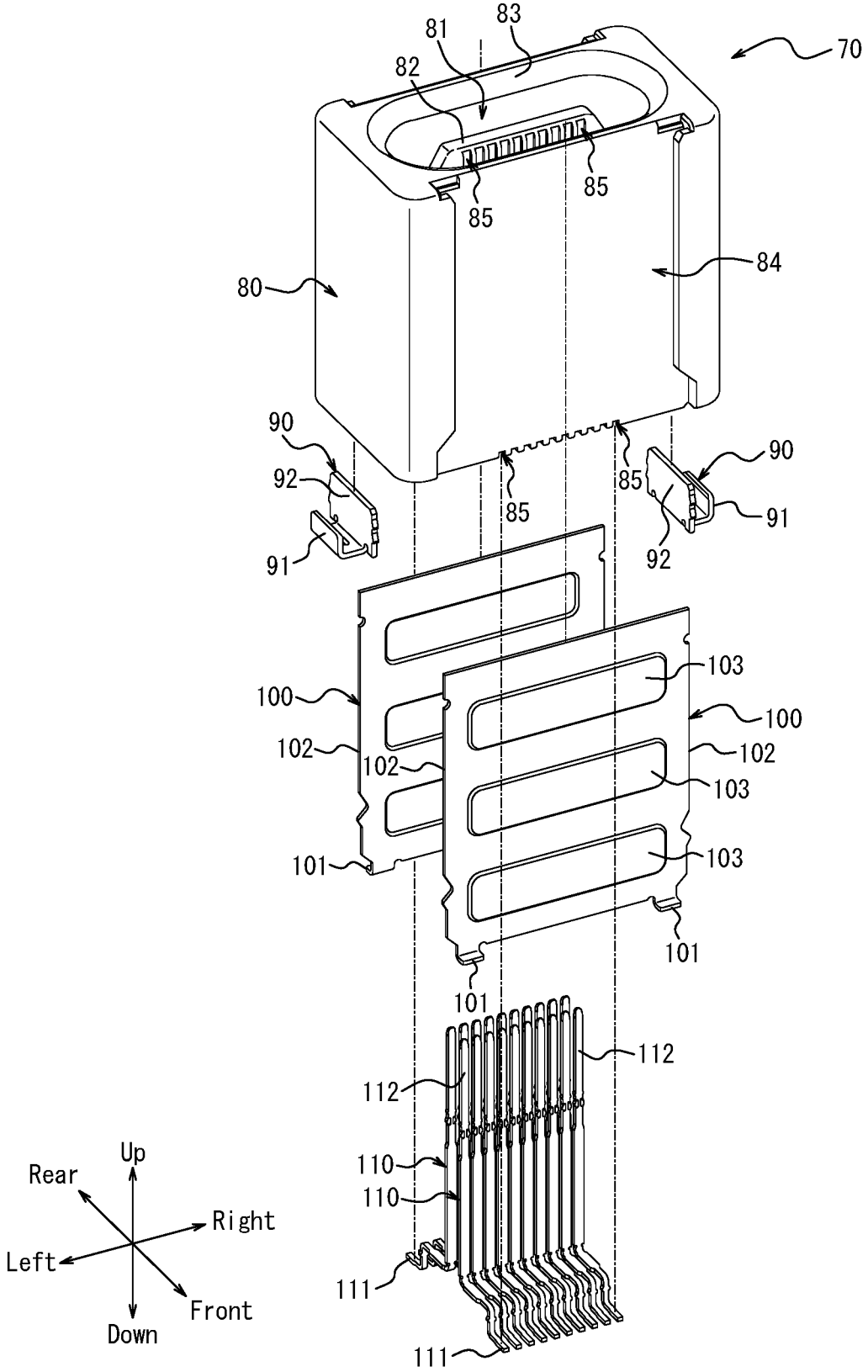
FIG. 12 is an exploded top perspective view of the connection object illustrated in FIG. 11.

As illustrated in FIG. 12, the connection object 70 includes an insulator 80, fitting brackets 90, fitting sheets 100, and the contacts 110, as main constituent elements. The connection object 70 is assembled by press-fitting the fitting brackets 90 and the contacts 110 into the insulator 80 from under the insulator 80 and press-fitting the fitting sheets 100 into the outer surface of the insulator 80.

The insulator 80 is a rectangular tubular member obtained by performing injection molding of a synthetic resin material having insulating and heat-resistant properties. The insulator 80 includes a fitting recess 81 formed on the top surface of the insulator 80. The insulator 80 includes a fitting projection 82 formed within the fitting recess 81. The insulator 80 includes a guiding portion 83 surrounding the fitting recess 81 across the entire upper edge of the fitting recess 81. The guiding portion 83 is formed as an inclined surface inclined obliquely outwardly in the upward direction at the upper edge portion of the fitting recess 81. The insulator 80 includes a recess 84 formed on each of the front and rear surfaces. The fitting sheets 100 are attached to the recesses 84.

The insulator 80 has a plurality of contact attachment grooves 85 formed on the front and rear sides of the bottom portion and the front and rear surfaces of the fitting projection 82. A plurality of contacts 110 are respectively attached to the plurality of contact attachment grooves 85. The number of the contact attachment grooves 85 corresponds to the number of contacts 110. The plurality of contact attachment grooves 85 are formed in a recessed manner and arranged side by side in the left-right direction.

Each of the fitting brackets 90 is obtained by shaping a thin plate made of any metallic material into a shape as illustrated in FIG. 12 using a progressive die (stamping). The fitting brackets 90 are arranged in the left and right end portions of the insulator 80. Each of the fitting brackets 90 includes a mounting portion 91 that is formed in a substantially U-shape and extends outward. Each of the fitting brackets 90 includes a latch 92 that is formed continuously with the upper portion of the mounting portion 91 and latches to the insulator 80.

Each of the fitting sheets 100 is obtained by shaping a thin plate made of any metallic material into a shape as illustrated in FIG. 12 using a progressive die (stamping). The fitting sheets 100 are arranged in the front and rear end portions of the insulator 80. Each of the fitting sheets 100 are formed in a sheet-like shape in an elevation view from the front-rear direction. Each of the fitting sheets 100 includes a mounting portion 101 outwardly extending in a substantially L shape at the lower end of the left and right end portions. Each of the fitting sheets 100 includes a latch 102 that extends in the up-down direction at the left and right edge portions thereof and latches to the insulator 80. Each of the fitting sheets 100 includes ridges 103 that are formed as a step raised outwardly on the outer surface and extend in the left-right direction. Each of the fitting sheets 100 includes three ridges 103 arranged parallel to each other in the up-down direction.

The contacts 110 are obtained by shaping a thin plate made of, for example, a copper alloy having spring elasticity such as phosphor bronze, beryllium copper, or titanium copper, or a Corson type copper alloy into the shape as illustrated in FIG. 12 using a progressive die (stamping). The surfaces of the contacts 110 are plated with gold or tin after forming a nickel plate base.

A plurality of contacts 110 are arranged along the left-right direction. Each of the contacts 60 includes a mounting portion 111 that is formed in an approximate L-shape and extends outward. Each of the contacts 110 includes a contact portion 112 that is formed at the upper end portion thereof and comes into contact with the elastic contact portion 69 of the contact 60 of the connector 10 when the connector 10 and the connection object 70 are fitted together.

In the connection object 70 having the above structure, the mounting portion 111 of each of the contacts 110 is soldered to the circuit pattern formed on the mounting surface of the circuit board CB2. The mounting portion 91 of each of the fitting brackets 90 and the mounting portion 111 of the each of the fitting sheets 100 are soldered to the ground pattern or the like formed on the mounting surface. In this way, the connection object 70 is mounted on the circuit board CB2. On the mounting surface of the circuit board CB2, electronic components other than the connection object 70 including, for example, a camera module, a sensor, and the like are mounted.

Operation of the connector 10 having a floating structure when the connection object 70 is fitted to the connector 10 will be described.

Figure 13:
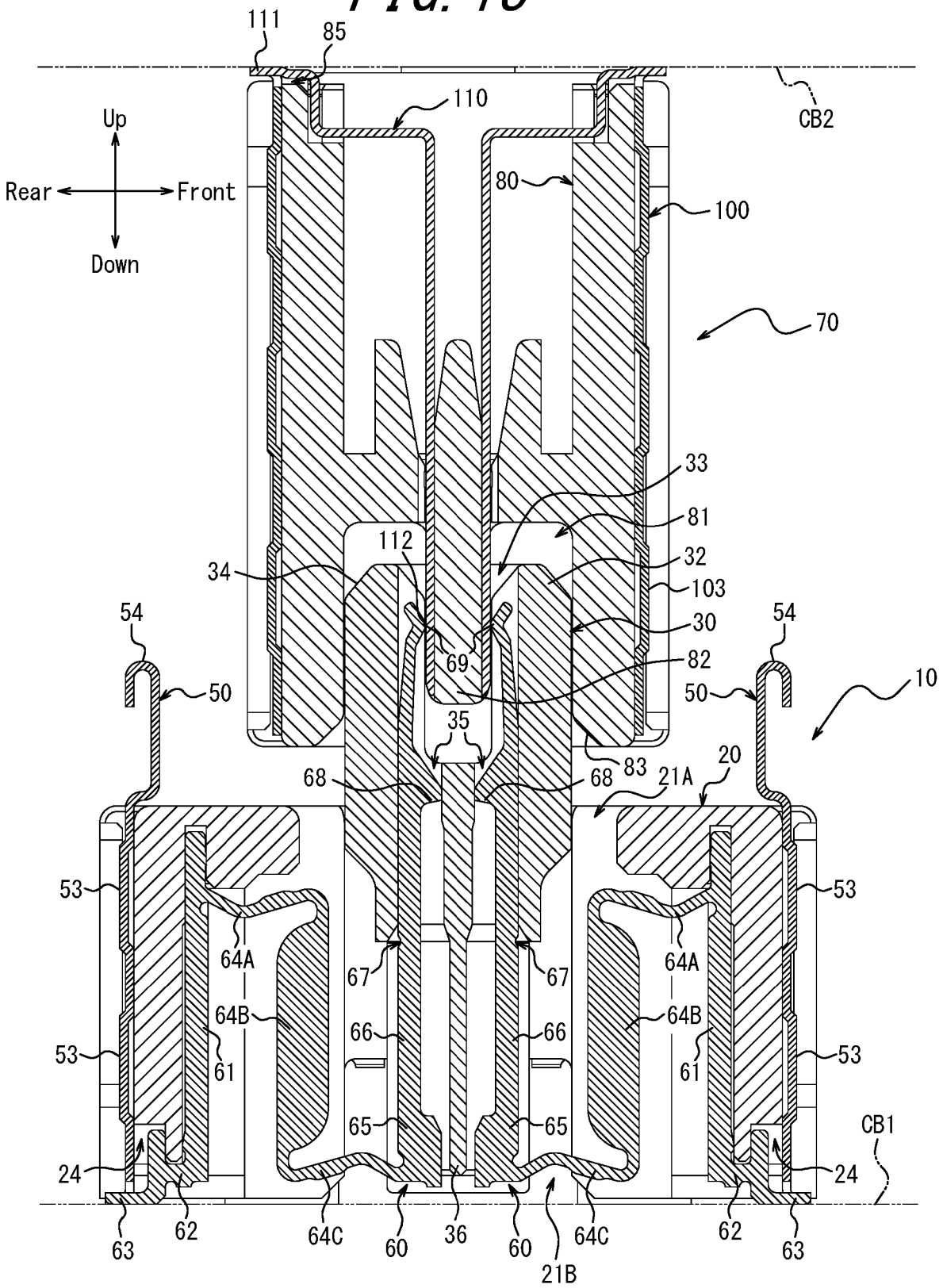
FIG. 13 is a cross-sectional view taken from arrow XIII-XIII illustrated in FIG. 1.

FIG. 13 is a cross-sectional view taken from arrow XIII-XIII of FIG. 1.

The contacts 60 of the connector 10 support the second insulator 30 in a state in which the second insulator 30 is spaced apart from the first insulator 20 and floating within the second insulator 30. At this time, the lower portion of the second insulator 30 is surrounded by the outer peripheral wall 22 of the first insulator 20. The upper portion of the second insulator 30 including the fitting recess 33 protrudes upward from the opening 21A of the first insulator 20.

When the mounting portions 63 of the contacts 60 are soldered to the circuit board CB1, the first insulator 20 is fixed to the circuit board CB1. The second insulator 30 is movable relative to the fixed first insulator 20 by virtue of elastic deformation of the first elastic portion 64A, the second elastic portion 64C, and the third elastic portion 66 of each of the contacts 60.

At this time, the peripheral edge portion of the opening 21A regulates excessive movement of the second insulator 30 with respect to the first insulator 20. When the second insulator 30 moves by a large amount and exceeds the design value due to the elastic deformation of the contacts 60, the fitting projection 32 of the second insulator 30 comes into contact with the peripheral edge portion of the opening 21A. Thus, the second insulator 30 does not move further outward.

In a state in which the connection object 70 is flipped over relative to the connector 10 having such a floating structure, the connector 10 and the connection object 70 are brought to oppose each other in such a manner that the front-rear positions and the left-right positions of the connector 10 and the connection object 70 substantially meet one another. Then, the connection object 70 is moved downward. At this time, even when the connector 10 and the connection object 70 are displaced from each other in the front-rear direction and the right-left direction, the guiding portion 34 of the connector 10 and the guiding portion 83 of the connection object 70 come into contact with each other. Thus, the second insulator 30 moves relative to the first insulator 20 due to the floating structure of the connector 10. In particular, the fitting projection 32 of the connector 10 is guided into the fitting recess 81 of the connection object 70.

When the connection object 70 is further moved downward, the fitting projection 32 of the connector 10 and the fitting recess 81 of the connection object 70 are fitted together. At this time, the fitting recess 33 of the connector 10 and the fitting projection 82 of the connection object 70 are fitted together. The contacts 60 of the connector 10 and the contacts 110 of the connection object 70 come into contact with one another in a state in which the second insulator 30 of the connector 10 and the insulator 80 of the connection object 70 are fitted together. In particular, the elastic contact portions 69 of the contacts 60 and the contact portions 1192 of the contacts 110 come into contact with one another. At this time, the distal ends of the elastic contact portions 69 of the contacts 60 elastically deform towards the outside slightly and are elastically displaced towards the inside of the contact attachment grooves 35.

In this way, the connector 10 and the connection object 70 are fully connected to each other. At this time, the circuit board CB1 and the circuit board CB2 are electrically connected to each other via the contacts 60 and the contacts 110.

In this state, the pair of elastic contact portions 69 of the contacts 60 clamps the pair of contacts 110 of the connection object 70 from both front and rear sides by applying an inward elastic force along the front-rear direction. By virtue of the reaction of the pressing force to the contact 110 applied by the connection object 70 thus generated, the second insulator 30 receives a force acting in a removal direction, i.e., the upward direction, via the contacts 60 when the connection object 70 is removed from the connector 10. Accordingly, when the second insulator 30 is moved upward, the retainer portions 43 of the fitting brackets 40 press-fitted into the first insulator 20 illustrated in FIG. 4 inhibit displacement of the second insulator 30. The retainer portions 43 of the fitting brackets 40 press-fitted into the first insulator 20 are positioned directly above the left and right end portions of the bottom portion 31 of the second insulator 30 inside the first insulator 20. Thus, when the second insulator 30 is moved upward, the left and right end portions of the bottom portion 31 protruding outward come into contact with the retainer portions 43. Thus, a further upward movement of the second insulator 30 is inhibited.

Figure 14:
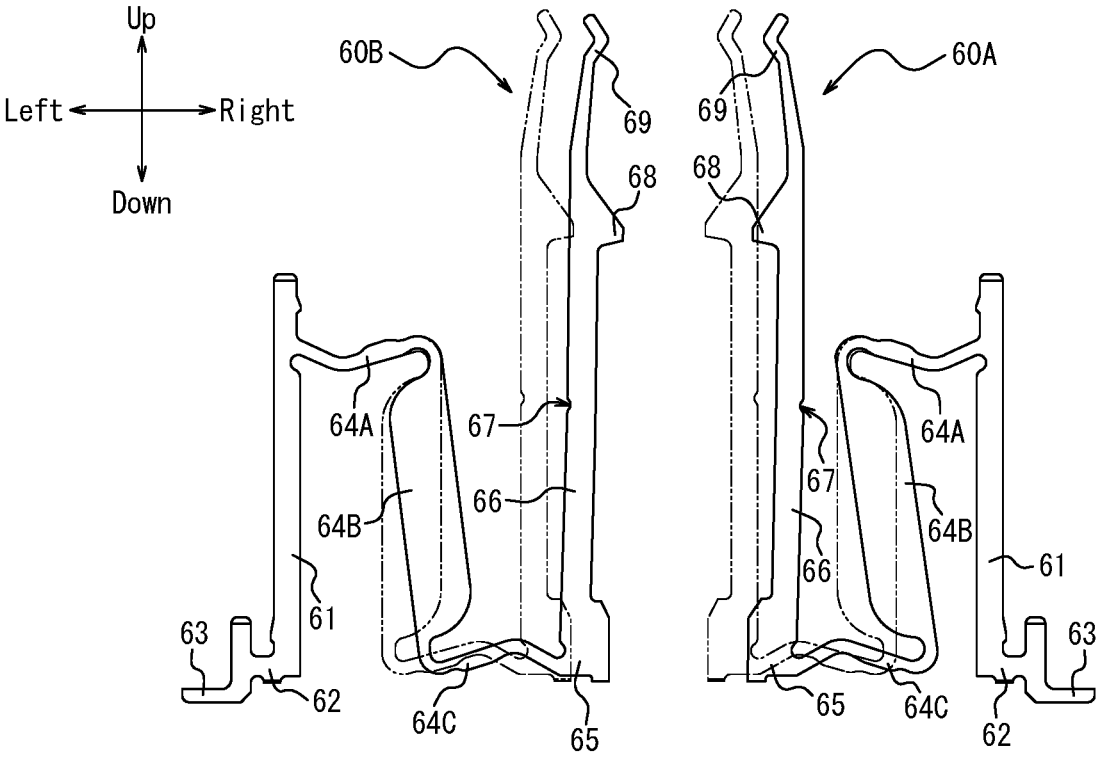
FIG. 14 is a schematic diagram illustrating a first example of elastic deformation of the pair of contacts.
Figure 15:
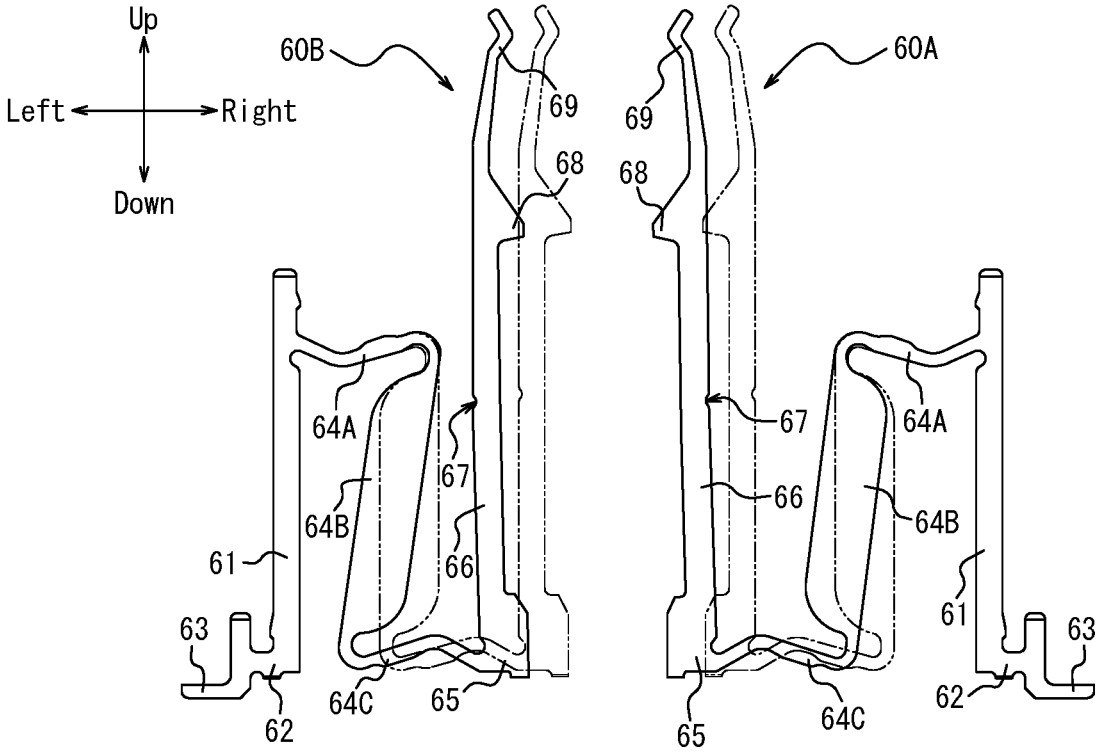
FIG. 15 is a schematic diagram illustrating a second example of elastic deformation of the pair of contacts.

FIG. 14 is a schematic diagram illustrating a first example of the elastic deformation of a pair of contacts 60. FIG. 15 is a schematic diagram illustrating a second example of the elastic deformation of the pair of contacts 60.

An operation performed by each constituent element when the pair of contacts 60 is elastically deformed will be described in detail with reference to FIG. 14 and FIG. 15. For the sake of simplicity of explanation, the contact 60 disposed on the right side in each of the drawings is referred to as a contact 60A, and the contact 60 disposed on the left side in each of the drawings will be described as a contact 60B. The two-dot chain lines in FIG. 14 and FIG. 15 indicate a state where the contacts 60A and 60B are not elastically deformed.

In FIG. 14, it is assumed that the second insulator 30 is moved to the right by some external factor, by way of example.

When the second insulator 30 is moved to the right, the latch 68 of the contact 60A is pushed to the right by the wall 36 of the second insulator 30. At this time, the third elastic portion 66 of the contact 60A is bent inward from the vicinity of the notch 67. The third elastic portion 66 of the contact 60A is elastically deformed more inward in the lower portion from the vicinity of the notch 67 than the upper portion. The relative position of the latch 68 of the contact 60A in contact with the wall 36 of the second insulator 30, with respect to the second insulator 30, is hardly changed. On the other hand, a relative position of the second base 65 of the contact 60A changes inward.

When the third elastic portion 66 of the contact 60A is moved to the right, the second elastic portion 64C is elastically deformed, and a connection point between the second elastic portion 64C and the adjustment portion 64B is also moved to the right. On the other hand, a connection point between the first elastic portion 64A and the adjustment portion 64B is slightly moved in left-right direction. Thus, the first elastic portion 64A is elastically deformed in such a manner that a bent portion at the inner end portion is bent outward, and the adjustment portion 64B is inclined obliquely rightward from the upper portion to the lower portion.

When the second insulator 30 is moved to the right, the latch 68 of the contact 60B is pushed to the right by the inner wall of the second insulator 30. At this time, the third elastic portion 66 of the contact 60B is bent outward from the vicinity of the notch 67. The third elastic portion 66 of the contact 60B is elastically deformed more outward in the lower portion from the vicinity of the notch 67 than the upper portion. A relative position of the latch 68 of the contact 60B in contact with the inner wall of the contact attachment groove 35 with respect to the second insulator 30 is hardly changed. On the other hand, a relative position of the second base 65 of the contact 60B is moved outward.

When the third elastic portion 66 of the contact 60B is moved to the right, the second elastic portion 64C is elastically deformed, and the connection point between the second elastic portion 64C and the adjustment portion 64B is also moved to the right. On the other hand, the connection point between the first elastic portion 64A and the adjustment portion 64B is slightly moved in the left-right direction. Thus, the first elastic portion 64A is elastically deformed such that the bent portion at the inner end portion is bent inward, and the adjustment portion 64B is inclined obliquely rightward from the upper portion to the lower portion.

In FIG. 15, it is assumed that the second insulator 30 is moved to the left by some external factor, by way of example.

When the second insulator 30 is moved to the left, the latch 68 of the contact 60A is pushed to the left by the inner wall of the second insulator 30. At this time, the third elastic portion 66 of the contact 60A is bent outward from the vicinity of the notch 67. The third elastic portion 66 of the contact 60A is elastically deformed more outward in the lower portion from the vicinity of the notch 67 than the upper portion. The relative position of the latch 68 of the contact 60A in contact with the inner wall of the contact attachment groove 35 with the second insulator 30, with respect to the second insulator 30, is hardly changed. On the other hand, a relative position of the second base 65 of the contact 60A is changed outward.

When the third elastic portion 66 of the contact 60A is moved to the left, the second elastic portion 64C is elastically deformed, and the connection point between the second elastic portion 64C and the adjustment portion 64B is also moved to the left. On the other hand, the connection point between the first elastic portion 64A and the adjustment portion 64B is slightly moved in the left-right direction. Thus, the first elastic portion 64A is elastically deformed such that the bent portion at the inner end portion is bent inward, and the adjustment portion 64B is inclined obliquely leftward from the upper portion to the lower portion.

When the second insulator 30 is moved to the left, the latch 68 of the contact 60B is pushed to the left by the wall 36 of the second insulator 30. At this time, the third elastic portion 66 of the contact 60B is bent inward from the vicinity of the notch 67. The third elastic portion 66 of the contact 60B is elastically deformed more inward in the lower portion from the vicinity of the notch 67 than the upper portion. A relative position of the latch 68 of the contact 60B in contact with the wall 36 of the second insulator 30 with the second insulator 30 is hardly changed. On the other hand, a relative position of the second base 65 of the contact 60B is changed inward.

When the third elastic portion 66 of the contact 60B is moved to the left, the second elastic portion 64C is elastically deformed, and the connection point between the second elastic portion 64C and the adjustment portion 64B is also moved to the left. On the other hand, the connection point between the first elastic portion 64A and the adjustment portion 64B is slightly moved in the left-right direction. Thus, the first elastic portion 64A is elastically deformed such that the bent portion at the inner end portion is bent outward, and the adjustment portion 64B is inclined obliquely leftward from the upper portion to the lower portion.

The connector 10 according to the present embodiment configured as described above has both a good floating structure and good transmission characteristics for signal transmission. In the connector 10, because each of the contacts 60 includes the adjustment portion 64B, the width, i.e., the cross-sectional area of each transmission path is increased, and the impedance is reduced. This brings the impedance of the first elastic portion 64A, the adjustment portion 64B, and the second elastic portion 64C close to the ideal value. The connector 10 can contribute to impedance matching. Therefore, according to the connector 10, desired transmission characteristics can be obtained for high capacity and high-speed transmission, and transmission characteristics can be further improved as compared to conventional electrical connectors that do not include the adjustment portion 64B.

In the connector 10, because each of the contacts 60 further includes the respective third elastic portions 66, the moving amount of the second insulator 30 relative to the first insulator 20 can be increased. Because the third elastic portion 66 is elastically deformed in addition to the elastic deformation of the first elastic portion 64A and the second elastic portion 64C, the moving amount of the second insulator 30 relative to the first insulator 20 increases. In other words, because the connector 10 can allocate a part of the elastic deformation amount of the contact 60 necessary to obtain a predetermined moving amount to the third elastic portion 66, the elastic deformation amounts of the first elastic portion 64A and the elastic portion 64C can be reduced. This enables a reduction in a total length of the first elastic portion 64A, the adjustment portion 64B, and the second elastic portion 64C, and a reduction in the front-rear direction width of the connector 10. Accordingly, the connector 10 can contribute to the miniaturization of the second insulator 30 while securing the necessary moving amount of the second insulator 30.

Because the total length of the first elastic portion 64A, the adjustment portion 64B, and the second elastic portion 64C is reduced, the transmission characteristics of the connector 10 is further improved. Because of the reduction in the signal transmission path, the connector 10 can transmit high frequency signals with less transmission loss.

Because the connector 10 includes the wall 36 at a position where the second insulator 30 opposes the second bases 65, the pair of contacts 60 arranged symmetrically in the front-rear direction in FIG. 7 can be prevented from coming into contact with each other. As described above, the second bases 65 connecting the second elastic portions 64C and the third elastic portions 66 are moved, for example, in the front-rear direction of FIG. 7 in accordance with the elastic deformation of the second elastic portions 64C and the third elastic portions 66. At this time, in a case where the second insulator 30 does not include the wall 36, the second bases 65 of the pair of contacts 60 arranged in the front-rear direction potentially come into contact with each other, depending on their respective elastic deformation states. By formation of the wall 36, the connector 10 can prevent the second bases 65 from coming into contact with each other, and thus reduce electrically-induced defects such as short circuiting and mechanically-induced defects such as breakage. In other words, by virtue of the wall 36, the connector 10 can regulate excessive elastic deformation of the third elastic portions 66. Even in situations where the second bases 65 are moved in accordance with the elastic deformation of the second elastic portions 64C and the third elastic portions 66, the connector 10 can secure its reliability as a product.

In the connector 10, because the first elastic portions 64A and the second elastic portions 64C extend from both fitting-direction ends of the adjustment portion 64B, necessary moving amounts of the adjustment portions 64B can be secured. Thus, the connector 10 can secure the necessary moving amount of the second insulator 30. In the connector 10, the integral formation of the first elastic portions 64A, the adjustment portions 64B, and the second elastic portions 64C in an approximate crank shape can contribute to a reduction in the front-rear length in FIG. 7 while exerting the aforementioned effect. For example, the first elastic portions 64A extend from the inner end portions of the upper edge portions of the adjustment portions 64B, and the second elastic portions 64C extend from the outer end portions of the lower edge portions of the adjustment portions 64B. Thus, the front-rear length of the connector 10 in its entirety is reduced. This configuration enables extension of the elastic deformation portions of the first elastic portions 64A and the second elastic portions 64C within the limited areas in the first insulator 20, and thus can realize an excellent floating structure.

Because the first elastic portions 64A, the adjustment portions 64B, and the second elastic portions 64C are arranged in the stated order from the fitting side along the fitting direction, the second bases 65 connected to the second elastic portion 64C are located in the lowest position. This enables extension of the third elastic portion 66 and larger elastic deformation. Consequently, the moving amount of the second insulator 30 relative to the first insulator 20 is increased.

In the connector 10, because the contacts 60 further include the respective notches 67, the force applied to the latches 68 in contact with the inner wall of the second insulator 30 when the second insulator 30 is moved can be reduced. Similarly, the connector 10 can reduce the force applied to the elastic contact portions 69 located in the upper portions of the contact attachment grooves 35. The connector 10 can bend the third elastic portions 66 below the vicinity of the notches 67. In particular, in the third elastic portions 66 of in the connector 10, the elastic deformation amounts in the lower half portions are larger than those of the upper half portions between the lower end portions of the latches 68 and the vicinities of the notches 67. Thus, in a state in which the locking of the latches 68 to the second insulator 30 and the contact of the elastic contact portions 69 with the contact portions 112 are stable, the third elastic portions 66 can contribute to the movement of the second insulator 30 relative to the first insulator 20.

Because the contacts 60 are made of a metallic material having a small elastic modulus, the necessary moving amount of the connector 10 can be secured in response to a small force applied to the second insulator 30. The second insulator 30 can smoothly move with respect to the first insulator 20. Thus, the connector 10 can easily accommodate a positional deviation when being fitted to the connection object 70. In the connector 10, each of the elastic portions of the contacts 60 absorbs vibrations caused by some external factor. This inhibits application of a large force to the mounting portion 63 and damage to a connection portion between the connector 10 and the circuit board CB1. In this way, when the connector 10 is connected to the connection object 70, the connector 10 can maintain reliable connection.

Because the connector 10 includes the second bases 65 configured as wide portions of the contacts 60, the connector 10 can improve product assembly. Because the second bases 65 are formed to be wide, the rigidity of the second bases 65 is increased. This enables the contacts 60 to be stably inserted from below into the first insulator 20 and the second insulator 30 by an assembling machine or the like, with the second bases 65 serving as fulcrums.

The fitting brackets 40 are press-fitted into the first insulator 20, and the mounting portions 41 are soldered to the circuit board CB1, whereby the fitting brackets 40 can stably fix the first insulator 20 to the circuit board CB1. The fitting brackets 40 improve the mounting strength of the first insulator 20 on the circuit board CB1.

Because the fitting brackets 40 are press-fitted into the first insulator 20 and the mounting portions 41 are soldered to the circuit board CB1, the fitting brackets 40 can be stably fixed to the first insulator 20 with respect to the circuit board CB1. The fitting brackets 40 improved mounting strength of the first insulator 20 with respect to the circuit board CB1.

It will be apparent to those who are skilled in the art that the present disclosure may be realized in forms other than the embodiment described above, without departing from the spirit and the fundamental characteristics of the present disclosure. Accordingly, the foregoing description is merely illustrative and not limiting in any manner. The scope of the present disclosure is defined by the appended claims, not by the foregoing description. Among all modifications, those modifications within equivalent scope shall be considered as being included in the present disclosure.

For example, the shape, the arrangement, and the number of each of the constituent elements described above are not limited to those in the above description and illustrated in the drawings. The shape, arrangement, and the number of each of the constituent elements may be appropriately determined to be able to realize its function. The assembly method of the connector 10 and the connection object 70 is not limited to that in the above description. Any assembly method of the connector 10 and the connection object 70 that enables the connector 10 and the connection object 70 to realize the respective functions may be employed. For example, the fitting brackets 40, the fitting sheets 50, or the contacts 60 may be integrally formed with the first insulator 20 or the second insulator 30 by insert molding, instead of press-fitting.

It has been described that, in the adjustment portions 64B, the electrical conductivity is improved by the increase in the widths of the transmission path, i.e., the cross-sectional area of the transmission path. However, configurations of the adjustment portions 64B that improve the electrical conductivity are not limited thereto. The adjustment portions 64B may have any configuration that improves the electrical conductivity. For example, the adjustment portions 64B may be formed to be thicker than the first elastic portions 64A while maintaining the same width. For example, the adjustment portions 64B may be made of a material having a higher electric conductivity than that of the first elastic portions 64A while maintaining the same cross-sectional areas. For example, the surfaces of the adjusting portions 64B may be subjected to plating for improving electrical conductivity while maintaining the cross-sectional areas the same as those of the first elastic portions 64A.

Provided that the connector 10 is able to contribute to the miniaturization of the connector 10 while securing a necessary moving amount of the second insulator 30, the connector 10 does not need to include the third elastic portions 66.

In a case where the third elastic portions 66 can contribute to the movement of the second insulator 30 in a state in which the engagement of the latches 68 and the contact of the elastic contact portions 69 are stable, the connector 10 does not need to include the notches 67.

Although it has been described that the second bases 65 are formed to be wider than the second elastic portions 64C, this is not restrictive. The second bases 65 do not need to have wide widths, in a case in which the second bases 65 can maintain the assembly property of the connector 10. Although it has been described that the wall 36 extends downward from the bottom surface of the fitting recess 33 within the contacts 60, this is not restrictive. For example, provided that the wall 36 is able to prevent contact between the pair of contacts 60, the wall 36 may be formed at a position facing the second bases 65 alone.

It has been described that the adjustment portions 64B extend in the fitting direction to be fitted in the connection object 70 when the first elastic portions 64A and the second elastic portions 64C are not elastically deformed, and the first elastic portions 64A and the second elastic portions 64C extend from the respective fitting-direction end portions of the adjustment portions 64B. However, this is not restrictive. The first elastic portions 64A, the adjustment portions 64B, and the second elastic portions 64C can be in any shape overall that can contribute to the miniaturization of the connector 10 while securing the necessary moving amount of the second insulator 30. For example, the adjustment portions 64B may extend in a manner deviated from the fitting direction. For example, the first elastic portions 64A and the second elastic portions 64C may extend from the respective end portions of the adjustment portions 64B in the front-rear direction of FIG. 7. For example, the first elastic portions 64A and the second elastic portions 64C may have any shapes with more bent portions. For example, the first elastic portions 64A, the adjustment portions 64B, and the second elastic portions 64C may form an approximate U-shape overall, instead of an approximate crank-shape.

It has been described as illustrated in FIG. 8 that the first elastic portions 64A, the adjustment portions 64B, and the second elastic portions 64C are arranged in the stated order from the fitting side along the fitting direction. However, this is not restrictive. The first elastic portions 64A, the adjustment portions 64B, and the second elastic portions 64C may be arranged in the stated order from the opposite side when they can contribute to the miniaturization of the connector 10 while securing the necessary moving amount of the second insulator 30.

Although it has been described that the first elastic portions 64A and the second elastic portions 64C are formed to be narrower than the first bases 61, this is not restrictive. The first elastic portions 64A and the second elastic portions 64C may have any configuration capable of securing respective necessary elastic deformation amounts. For example, the first elastic portions 64A or the second elastic portions 64C may be made of a metal material having a smaller elastic modulus than the other portions of the contacts 60.

Although the contacts 60 have been described as being made of a metal material having a small elastic modulus, this is not restrictive. The contacts 60 may be made of any metal material having any elastic modulus that can secure the necessary elastic deformation amount.

Although the connection object 70 has been described as a receptacle connector connected to the circuit board CB2, this is not restrictive. The connection object 70 may be any object other than a connector. For example, the connection object 70 may be an FPC, a flexible flat cable, a rigid board, or a card edge of any circuit board.

The connector 10 described above is mounted in an electronic device. The electronic device includes, for example, any in-vehicle device such as a camera, a radar, a drive recorder, or an ECU (engine control unit). The electronic device includes any in-vehicle device used in an in-vehicle system such as a GPS navigation system, an advanced driving support system, or a security system. The electronic device includes, for example, any information device such as a personal computer, a copy machine, a printer, a facsimile, or a multifunction machine. The electronic equipment also includes any industrial equipment.

Electronic devices as described above have excellent transmission characteristics for signal transmission. Because the floating structure of the connector 10 accommodates the positional deviation between the substrates in an excellent manner, the workability at the time of assembling the electronic devices is improved. The electronic devices can be easily manufactured. Because the connector 10 inhibits damage to the connection portion between the connector 10 and the circuit board CB1, the reliability of the electronic device as a product is improved.

REFERENCE SIGNS LIST

10 connector
20 first insulator
21A, 21B opening
22 outer peripheral wall
23 recess
24 contact attachment groove
30 second insulator
31 bottom portion
32 fitting projection
33 fitting recess
34 guiding portion
35 contact attachment groove
36 wall
40 fitting bracket
41 mounting portion
42 continuous portion
43 retainer portion
44 latch
50 fitting sheet
51 mounting portion
52 latch
53 ridge
54 bending portion
60, 60A, 60B contact
61 first base
62 latch
63 mounting portion
64A first elastic portion
64B adjustment portion
64C second elastic portion
65 second base
66 third elastic portion
67 notch
68 latch
69 elastic contact portion (contact portion)
70 connection object
80 insulator
81 fitting recess
82 fitting projection
83 guiding portion
84 recess
85 contact attachment groove
90 fitting bracket
91 mounting portion
92 latch
100 fitting sheet
101 mounting portion
102 latch
103 ridge
110 contact
111 mounting portion
112 contact portion
CB1, CB2 circuit board

The invention claimed is:

1. A connector comprising:

a first insulator formed in a frame shape;

a second insulator that is arranged inside said first insulator and is to be fitted to a connection object and movable relative to said first insulator; and a plurality of contacts attached to said first insulator and said second insulator, wherein said contacts include, between said first insulator and said second insulator, a first elastic portion that is elastically deformable, an adjustment portion and a second elastic portion that is elastically deformable, and wherein, with respect to a first direction and a second direction perpendicular to an arrangement direction of said plurality of contacts, a width of said adjustment portion in the first direction perpendicular to an extension direction of said adjustment portion is larger than a width of said first elastic portion in the second direction perpendicular to an extension direction of said first elastic portion and is larger than a width of said second elastic portion in the second direction perpendicular to an extension direction of said second elastic portion.

2. The connector according to claim 1, wherein said adjustment portion has a larger cross-sectional area than said first elastic portion.

3. The connector according to claim 1, wherein said adjustment portion has a larger cross-sectional area than said second elastic portion.

4. The connector according to claim 1, wherein said contacts further include a third elastic portion that is arranged along an inner wall of said second insulator, extends in a fitting direction of said connection object, and is elastically deformable.

5. The connector according to claim 4, wherein said contacts further include a base that connects said second elastic portion and said third elastic portion.

6. The connector according to claim 5, wherein said second insulator includes a wall formed at a position opposing said base.

7. The connector according to claim 1, wherein said adjustment portion extends in a fitting direction of said connection object, and said first elastic portion and said second elastic portion extend from respective end portions of said adjustment portion in said fitting direction.

8. The connector according to claim 7, wherein said first elastic portion, said adjustment portion, and said second elastic portion are sequentially arranged along said fitting direction from a fitting side.

9. An electronic device comprising said connector according to claim 1.

* * * * *